United States Patent [19]

Kurfman

[11] Patent Number: 4,510,208

[45] Date of Patent: Apr. 9, 1985

[54] DUPLEX METAL ALLOY/POLYMER COMPOSITIONS

[75] Inventor: Virgil B. Kurfman, Midland, Mich.

[73] Assignee: The Dow Chemical Company, Midland, Mich.

[21] Appl. No.: 510,029

[22] Filed: Jul. 1, 1983

[51] Int. Cl.[3] ..... B32B 5/00; B32B 15/08; C23C 13/02

[52] U.S. Cl. ..... 428/624; 428/31; 428/336; 428/645; 428/646; 428/673; 428/674

[58] Field of Search ..... 428/624, 31, 336, 645, 428/646, 673, 674

[56] References Cited

U.S. PATENT DOCUMENTS

| | | | |
|---|---|---|---|
| 3,686,018 | 8/1972 | Lindblom et al. | 428/336 |
| 4,115,619 | 9/1978 | Kurfman et al. | 428/31 |
| 4,211,822 | 7/1980 | Kurfman et al. | 428/31 |

*Primary Examiner*—Veronica O'Keefe
*Attorney, Agent, or Firm*—Dan R. Howard; Thomas J. Mielke

[57] ABSTRACT

A multilayer metal/organic polymer composite which has a formable thermoplastic polymer layer, a first metal layer adhered to the polymer layer and a second metal layer adhered to the first metal layer. The first metal layer is formed either from one metal or from an alloy of two or more metals. Suitable alloys are those which begin melting at a temperature within a range of from about 85 to 150 percent of the forming temperatures in degrees Kelvin of the polymer layer. If the first meal layer is formed from one metal, the metal is suitably, copper, silver, nickel or manganese. The second metal layer is a metal or an alloy of two or more metals that melts at a temperature which is less than that at which the first metal layer melts. The two metal layers, when taken together and heated to a specific temperature, comprise an alloy of two or more metals which melts at a temperature or over a range of temperatures within a temperature range of from about 80 to about 135 percent of the forming temperature in degrees Kelvin of the polymer layer. The multilayer composites have an optical density measurement of not less than 2.0 after being increased in area up to about 300 percent.

16 Claims, No Drawings

DUPLEX METAL ALLOY/POLYMER COMPOSITIONS

BACKGROUND OF THE INVENTION

This invention relates to a method of preparing multilayer metal/organic polymer composites. The multilayer composites have at least one thermoplastic organic polymer layer, a first metal layer adhered to at least one surface of the polymer layer and at least one additional metal layer adhered to the first metal layer. This invention also relates to the multilayer composites so prepared and to articles formed from such multilayer composites.

Metallized plastic articles have been prepared by applying a metal layer to a plastic material. Application of the metal layer has been accomplished by vacuum deposition, electrolytic or electroless deposition, foil lamination or similar metallizing techniques. Metallized plastic films so prepared have been used for decorative purposes because of properties such as flexibility and ability to be shaped to some extent to conform to various contours.

Unfortunately, the degree to which earlier versions of such metallized films or sheets or other articles can be shaped without rupture and/or separation of the metal from the polymer is limited. Accepted limitations include restricting localized dimensional changes to less than 25% in one direction and less than 20% in area.

Metallized films prepared in accordance with U.S. Pat. Nos. 4,115,619 and 4,211,822, the teachings of which are incorporated herein by reference thereto, are limited in terms of extensibility to an increase in area of at least 30%, preferably from about 50 to about 300%. A noticeable loss in both specular reflectance and optical density results at points of excessive elongation when such metallized films are stretched beyond the aforementioned limits. Even within said limits, a marked loss of optical density occurs when the metallized films are stretched at a forming temperature which exceeds the film's glass transition temperature, in degrees Kelvin, by 5 percent or more.

A formed article, where excessive stretching has taken place, has a marred appearance and diminished utility in decorative, electrical and packaging applications.

It would be desirable if there were available a process for preparing a multilayer, metal/organic polymer composite having at least two compositionally different metal alloy layers adhered to at least one surface of a thermoplastic organic polymer layer. Such a composite, after an increase in area of at least 30 percent, beneficially from about 50 to about 300 percent would desirably exhibit excellent specular reflectance, electroconductivity and barrier to vapor transmission.

It would also be desirable if the multilayer composite so produced had a high retention of optical density after being extended to an area which is at least 30 percent, desirably from about 50 to about 300 percent, greater than its original area. The multilayer composite has a high retention of optical density if it has an optical density, after extension, of at least 2, beneficially at least 3, and desirably at least 4.

SUMMARY OF THE INVENTION

In one aspect, the present invention is a duplex metal/organic polymer multilayer composite structure. The structure comprises at least three different types of layers.

The structure has at least one normally solid, formable thermoplastic polymer layer. The polymer layer has a forming temperature in degrees Kelvin. The polymer layer also has a first planar surface and a second planar surface. The first and second planar surfaces are generally parallel to each other.

The structure also has a first normally solid metal layer. The first metal layer is intimately adhered to at least one planar surface of at least one polymer layer. The first metal layer is formed from an alloy of two or more metals that melts at a temperature, or over a range of temperatures, that is within a specific temperature range. The specific temperature range is from about 85 to about 150 percent of the forming temperature of the thermoplastic polymer. All temperatures are in degrees Kelvin.

The structure also has a second normally solid metal layer. The second metal layer is intimately adhered to the first metal layer. The second metal layer is formed from a metal or an alloy of two or more metals. The metal or alloy of the second metal layer melts at a temperature, or over a range of temperatures, which is lower than that at which, or over which, melting of the metal alloy of the first metal layer occurs. These temperatures are also in degrees Kelvin.

In a second aspect, the present invention is a method of preparing a duplex metal/organic polymer multilayer composite structure. The method comprises three steps.

A first step comprises providing at least one normally solid, formable thermoplastic polymer layer. The thermoplastic polymer layer has a forming temperature in degrees Kelvin. The polymer layer also has a first planar surface and a second planar surface. The first and second planar surfaces are generally parallel to each other.

A second step comprises intimately adhering a first metal layer to at least one planar surface of at least one polymer layer. The first metal layer is formed from a normally solid metal alloy of two or more metals. The metal alloy has a solidus temperature and a liquidus temperature, both of which are in degrees Kelvin. The alloy also has a melting temperature or melting temperature range that is within a specific temperature range. The specific temperature range is from about 85 to about 150 percent of the forming temperature of the thermoplastic polymer layer. All temperatures are in degrees Kelvin.

A third step comprises intimately adhering a second normally solid metal layer to at least one first metal layer. The second metal layer is formed from a metal or an alloy of two or more metals. The metal or alloy melts at a temperature, or over a range of temperatures, which is lower than that at which, or over which, the metal alloy of the first metal layer melts. The metal or alloy which forms the second metal layer has a liquidus temperature and a solidus temperature.

In a third aspect, the present invention is a duplex metal/organic polymer multilayer composite.

The composite comprises at least one normally solid, formable thermoplastic polymer layer. The polymer layer has a forming temperature in degrees Kelvin. The polymer layer also has a first planar surface and a second planar surface. The first and second planar surfaces are generally parallel to each other.

The structure also has at least one normally solid, first metal layer. The first metal layer is intimately adhered to at least one planar surface of at least one polymer layer. The first metal layer has a liquidus temperature and a solidus temperature.

The structure also has at least one normally solid second metal layer. The second metal layer is adhered to at least one first metal layer. The second metal layer comprises a metal or an alloy of two or more metals that melts at a temperature, or over a range of temperatures, which is lower than that at which, or over which, the metal of the first metal layer melts. The metal or alloy of the second metal layer has a solidus temperature and a liquidus temperature.

The metal layers are in such a proportional relationship with respect to each other that, when taken together and heated to a specific temperature, they comprise a segregated metal alloy of at least two metals. The specific temperature is (1) between the solidus temperature and the liquidus temperature of the first metal layer and (2) greater than the liquidus temperature of the second metal layer. The segregated metal alloy has a melting temperature or melting temperature range that is within a temperature range of from about 80 to about 135 percent of the forming temperature of the thermoplastic polymer layer. The segregated metal alloy has a liquidus temperature that is not less than the forming temperature of the thermoplastic polymer. All temperatures in the third aspect are in degrees Kelvin.

In a fourth aspect, the present invention is a method of preparing a duplex metal/organic polymer multilayer composite structure. The method comprises two steps.

A first step comprises providing a normally solid, formable thermoplastic polymer layer which has a first metal layer intimately adhered to at least one planar surface thereof. The metal layer is formed from a normally solid alloy of two or more metals. The first metal layer has a solidus temperature and a liquidus temperature. The polymer layer has a forming temperature.

A second step comprises intimately adhering a second normally solid metal layer to the first metal layer. The second metal layer has a solidus temperature and a liquidus temperature. The second metal layer is in such a proportional relationship with respect to the first metal layer that the two metal layers, when taken together and heated to a specific temperature, comprise a segregated alloy of at least two metals. The specific temperature is (1) between the solidus temperature and the liquidus temperature of the first metal layer and (2) greater than the liquidus temperature of the second metal layer. The segregated metal alloy has a melting temperature or melting temperature range that is within a temperature range of from 80 to about 135 percent of the forming temperature of the thermoplastic polymer layer. All temperatures are in degrees Kelvin.

In a fifth aspect, the present invention is a method of preparing a duplex metal/organic polymer multilayer composite structure. The method comprises three steps.

A first step comprises providing at least one normally solid, formable thermoplastic polymer layer. The polymer layer has a forming temperature in degrees Kelvin. The polymer layer also has a first planar surface and a second planar surface. The first and second planar surfaces are generally parallel to each other.

A second step comprises intimately adhering a first normally solid metal layer to at least one planar surface of at least one polymer layer. The first metal layer is a normally solid alloy of two or more metals. The first metal layer has a solidus temperature and a liquidus temperature.

A third step comprises intimately adhering a second normally solid metal layer to the first metal layer. The second metal layer has a solidus temperature and a liquidus temperature. The second metal layer is in such a proportional relationship with respect to the first metal layer that the two metal layers, when taken together and heated to a specific temperature, comprise a segregated alloy of at least two metals. The specific temperature is (1) between the solidus temperature and the liquidus temperature of the first metal layer and (2) greater than the liquidus temperature of the second metal layer. The segregated metal alloy has a melting temperature or melting temperature range that is within a temperature range of from 80 to about 135 percent of the forming temperature of the thermoplastic polymer layer. All temperatures are in degrees Kelvin.

In a sixth aspect, the present invention is a method of preparing a duplex metal/organic polymer multilayer composite structure. The method comprises two steps.

A first step comprises providing a normally solid, formable thermoplastic polymer layer which has a first metal layer intimately adhered to at least one planar surface thereof. The thermoplastic polymer layer has a forming temperature in degrees Kelvin. The first metal layer has a thickness of from 50 to about 300 Angstroms. The first metal layer is formed from one normally solid metal selected from the group consisting of copper, silver, nickel and manganese.

A second step comprises intimately adhering a second normally solid metal layer to the first metal layer. The second metal layer has a solidus temperature and a liquidus temperature. The second metal layer is in such a proportional relationship with respect to the first metal layer that the two metal layers, when taken together and heated to the forming temperature of the polymer layer, comprise a segregated alloy of at least two metals. The segregated alloy has a melting temperature or melting temperature range that is within a temperature range of from 80 to about 135 percent of the forming temperature of the thermoplastic polymer layer. All temperatures are in degrees Kelvin.

In still another aspect, the present invention is a shaped article comprising (1) one of the aforementioned formed composites and (2) a reinforcing material in intimate contact with at least one surface of the formed composite.

Surprisingly, the formed composite of this invention exhibits specular brightness, barrier, optical density and/or electrical continuity that are nearly the same as those of the composite prior to forming. In fact, the metal/organic polymer composites of the present invention exhibit electrical resistivities less than 5 ohms per square even after forming. Electrical resistivities, after forming, are preferably on the order of about 1 ohm per square or less.

The metal layer of the formed composite of this invention remains strongly adhered to the polymer layer. Strong adhesion is obtained even though forming of the composite is carried out at temperatures at which most, if not all, of the metal in the two metal layers is in the melted state and the polymer layer is in a heat-plastified state or nearly so.

DESCRIPTION OF THE PREFERRED EMBODIMENTS

In order to better understand the present invention, the following definitions, abstracted from pages 1–16, *Metals Handbook,* copyright 1948, are provided:

(a) alloy: a substance that has metallic properties and is composed of two or more chemical elements of which at least one is a metal;

(b) coring: variable composition in solid-solution dendrites; the center of the dendrite is richer in one element, as shown by the pertinent solidus-liquidus lines in a phase diagram;

(c) dendrite: a crystal formed usually by solidification and characterized by a treelike pattern composed of many branches; also termed "pine tree" and "fir tree" crystal;

(d) gravity segregation: variable composition caused in a casting by the settling of the heavier constituents;

(e) inverse segregation: a concentration of certain alloy constituents that have lower melting points, in the region corresponding to that first solifying; caused by interdendritic flow of enriched liquid through channels where the pressure drops with contraction of dendrites. The internal evolution of hydrogen may also give a positive pressure, aiding this flow and causing a liquated surface or tin sweat;

(f) liquated surface: a surface of an ingot that exhibits exudations or protuberances as a result of inverse segregation;

(g) liquation: the partial melting of an alloy, which can be used to effect a separation of two or more constituents;

(h) segregation: in an alloy object, concentration of alloying elements at specific regions, usually as a result of the primary crystallization of one phase with the subsequent concentration of other elements in the remaining liquid. Microsegregation refers to normal segregation on a microscopic scale whereby material richer in alloying element freezes in successive layers on the dendrites (coring) and in the constituent network. Macrosegregation refers to gross differences in concentration (for example, from one area of an ingot to another, which may be normal, inverse or gravity segregation.

Polymers suitably employed as the polymer layer(s) of the multilayer composites of this invention are those normally solid, organic, formable, thermoplastic polymers that are readily shaped or molded or otherwise fabricated into desired forms. As used herein, "formable" means the polymer can be stretched or otherwise extended without rupturing to occupy an area at least 30% greater than its original area, suitably from about 50 to about 300% greater than its original area.

The term "thermoplastic" as used herein is intended to include all synthetic resins that may be softened by heat and then regain their original properties upon cooling. Also included within this term are thermosetting resins in the B stage, i.e., that stage prior to crosslinking wherein the thermosetting resin exhibits heat plastification characteristics of a thermoplastic resin. In some preferred embodiments, the thermoplastic polymers are also generally transparent.

Because of their lower cost and superior structural properties, polymers of particular interest in the practice of this invention include engineering thermoplastics. Suitable engineering thermoplastics include polystyrene, styrene/acrylonitrile copolymers, copolymers containing polymerized styrene, acrylonitrile and butadiene (often called ABS polymers), styrene/butadiene copolymers, rubber modified styrene polymers, styrene/maleic anhydride copolymers and similar polymers of monovinylidene aromatic carbocyclic monomers; polycarbonates including those made from phosgene and bisphenol A and/or phenolphthalein; polyesters such as polyethylene terephthalate; acrylic resins such as poly(methyl methacrylate); polyacetyl resins such as polyformaldehyde resin; nitrile resins such as polyacrylonitrile and other polymers of $\alpha,\beta$-ethylenically unsaturated nitriles such as acrylonitrile/methyl methacrylate copolymers; polyamides such as nylon; polyolefins such as polyethylene and polypropylene; polyvinyl halides such as polyvinylchloride and vinylidene chloride homopolymers and copolymers; polyurethanes; polyallomers; polyphenylene oxides; polymers of fluorinated olefins such as polytetrafluoroethylene; and other normally solid polymers which can be formed while in the solid state into a desired shape by conventional forming techniques. Conventional forming techniques are cold drawing, vacuum drawing, drape molding, pressure thermoforming, scrapless thermoforming procedures and the like.

Large extensions of polymer film layers and of metal layers are usually accomplished by using high temperatures and/or high pressure. The use of high pressure processes allows extensive deformation without rupture.

With the present invention, increases in area of the multilayer composite of up to about 300% are attainable without using high pressure processes.

Preferred polymers, particularly where toughness and transparency are desired, are the polycarbonates. Preferred polycarbonates are those derived from the bis(4-hydroxyphenol)alkylidenes (often called bisphenol A types) and those derived from the combination of such bisphenol A type diols with phenolphthalein type diols.

The polymer layer of the multilayered composite may also contain one or more additaments provided said additaments do not interfere with performance of the composite. Suitable additaments are dyes, light stabilizers, reinforcement fillers and fibers, pigments, carbon black and the like.

Polymer layer thickness is not particularly critical. The polymer layer is of suitable thickness if it meets two limitations. First, it must be capable of being formed into a continuous layer which will have the necessary strength to survive conditions normal to its intended use. Second, it must be capable of withstanding rupturing during thermoforming. The thickness of the polymer layers(s) is beneficially in the range from about 2 to about 10,000 micrometers, preferably from about 10 to about 500 micrometers.

The first metal layer and the second metal layer, when taken together comprise a duplex alloy structure. The duplex alloy structure of the multilayer composite imparts specular reflectance and electroconductivity when such are desired. The duplex alloy structure of the multilayer composite is particularly suitable for imparting high barrier and high optical density to the composite.

The first metal layer is suitably formed either from one metal or from an alloy of two or more metals.

If the first metal layer is to be formed from one metal, the metal is selected from the group consisting of copper, silver, nickel and manganese. Each of these metals has a melting point which exceeds the forming temperature of any of the thermoplastic polymers suitable for use in the present invention. It has been found that melting of the first metal layer is not required for the formation of a duplex alloy structure. Heating the multilayer composite structure to a temperature which equals or exceeds the forming temperature of the polymer layer will ensure formation of the duplex alloy structure. Care must be taken, however, not to exceed a temperature at which the polymer layer degrades or decomposes.

If the first metal layer is to be formed from an alloy, the alloy is desirably one which begins melting at a temperature or over a range of temperatures that is within a particular temperature range. The particular temperature range is from about 85 to about 150 percent of the forming temperature ($T_f$), in degrees Kelvin (°K.), of the thermoplastic polymer layer.

The alloy of the first metal layer beneficially has a solidus temperature ($T_s$) which is within a temperature range of from about 0.85 $T_f$ to about 0.98 $T_f$. The solidus temperature is that temperature in degrees Kelvin at which the metal or alloy just begins to liquefy.

The alloy of the first metal layer also beneficially has a liquidus temperature ($T_l$) which is within a temperature range of from about 1.02 $T_f$ to about 1.50 $T_f$. The liquidus temperature is that temperature in degrees Kelvin at which the metal or alloy is entirely liquid. In other words, the alloy of the first metal layer must be at most only partially liquid at the forming temperature of the polymer layer when the composite is being formed.

It has been found that if the solidus temperature of the alloy of the first metal layer is less than about 0.85 $T_f$, the alloy may have a tendency to "bead up" on the surface of the thermoplastic polymer layer rather than form a generally uniform layer thereon.

For purposes of the present invention, a solidus temperature which is greater than about 1.2 $T_f$ greatly restricts the extent to which the composite structure may be thermoformed without rupturing either the polymer layer or the duplex alloy structure of said composite structure.

In the same manner, a liquidus temperature which is less than about 1.02 $T_f$ may lead to "beading up". A liquidus temperature which is greater than about 1.50 $T_f$ may restrict thermoformability of the composite.

The second metal layer suitably comprises a metal or an alloy of two or more metals. The metal or metal alloy of the second metal layer suitably melts at a temperature, or over a range of temperatures, which is lower than that at which, or over which, the metal or alloy of the first metal layer melts.

The metal or alloy of the second metal layer beneficially has a liquidus temperature, in °Kelvin, which is with in a temperature range of from about 0.90 to about 1.25 $T_f$, desirably from about 0.95 to about 1.10 $T_f$.

The metal or alloy of the second metal layer has a solidus temperature, in °Kelvin, which is beneficially within a temperature range of from about 0.80 to about 0.98 $T_f$, desirably from about 0.85 to about 0.95 $T_f$.

Desirably, the liquidus and solidus temperatures of the metal or alloy of the second metal layer are such that when the alloy of the first metal layer is about 50 weight percent liquid, the metal or alloy of the second metal layer is greater than 95 weight percent liquid, based on respective metal layers.

The first and second metal layers are beneficially in such a proportional relationship with respect to each other that, when taken together and heated to a specific temperature, they comprise a segregated metal alloy of at least two metals. The segregated metal alloy melts at a temperature or over a range of temperatures that is within a temperature range. The temperature range is from about 80 to about 135 percent of the forming temperature, in degrees Kelvin, of the thermoplastic polymer layer.

If the first metal layer is formed from one metal, the specific temperature is within a temperature range which depends upon polymer layer properties. The temperature range has a lower end and an upper end. The lower end is the forming temperature of the polymer layer. The upper end is the temperature at which the polymer layer degrades.

If the first metal layer is formed from an alloy of two or more metals, the specific temperature must meet two criteria. First, the specific temperature must be between the solidus and liquidus temperatures of the first metal layer. Second, the specific temperature must be greater than the liquidus temperature of the second metal layer.

Desirably, the first metal layer has a specific composition and proportion relative to the second metal layer. The composition is such that intermetallic phases formed by interaction between the first and second metal layers do not increase the liquidus temperature of the second metal layer beyond 135 percent of the forming temperature of the thermoplastic polymer layer.

The first and second metal layers discussed herein will, when placed in intimate contact with each other, show a discernible degree of intermingling and mutual alloying. If relatively low melting metal alloys are used in the first and second metal layers, such mutual alloying will be appreciable after two or three days, even at room temperature. If the metal alloys used in the first and second metal layers exhibit significant mutual solid solubility, mutual alloying will be especially pronounced. See, M. Hansen, *Constitution of Binary Alloys*, McGraw-Hill Book Company, Inc.

The first and second metal layers are suitably selected from closely related metal alloy systems. This will minimize potential adverse effects resulting from mutual alloying.

One potential adverse effect is that mutual alloys which are formed will have melting points or melting point ranges which are undesirable. The melting points or melting point ranges are undesirable when they are either too high or too low. Mutual alloys having melting points or ranges which are too high develop cracks, crevices and voids when subjected to stress at the forming temperature of the thermoplastic polymer layer. Mutual alloys having melting points or ranges which are too low exhibit "beading up" on the polymer layer. In severe cases, mutual alloys having melting points or ranges which are too low promote delamination of the metal layers from the polymer layer.

A second potential adverse effect is the formation of galvanic couples. Galvanic couples are undesirable because they generally lead to poor corrosion resistance.

One limitation placed upon selection of alloy compositions for the first and second metal layers is that the liquidus temperature of a mutual alloy formed therefrom must not be less than the forming temperature of the thermoplastic polymer layer of the multilayer composite.

Kurfman et al., in U.S. Pat. No. 4,115,619, the teachings of which are incorporated herein by reference thereto, teach that concentrated alloys are more easily extended than dilute alloys. An alloy is "concentrated" if it contains more than 20 percent by weight of alloy of minor alloy components. An alloy is "dilute" if it contains only minimal amounts of minor alloy components.

Although undiluted indium may be used as the second metal layer, a concentrated binary, or two-component, alloy is generally more suitable for purposes of the present invention. Illustrative concentrated binary alloys are bismuth-cadmium alloys, bismuth-indium alloys, bismuth-lead alloys, bismuth-tin alloys, cadmium-indium alloys, cadmium-zinc alloys, indium-tin alloys and lead-tin alloys. The order in which a metal is shown for a particular concentrated binary alloy has no significance. Either metal may be the major component and they may be present in equal amounts.

Each of the aforementioned binary alloys has a eutectic temperature. At the eutectic temperature both metals of the alloy come out of solution together to form a eutectic composition.

Binary alloy compositions of greatest interest for use in the second metal layer are those which have a solidus temperature which is within five degrees Kelvin of the eutectic temperature for that particular binary alloy. Each of these compositions suitably has a liquidus temperature which is greater than or equal to its solidus temperature. As the binary alloy composition approaches the eutectic composition, the liquidus temperature will also approach the eutectic temperature.

The first metal layer is suitably prepared from a different composition of the same binary alloy as that used to prepare the second metal layer. By different composition, it is meant that the composition of the first metal layer is further removed from the eutectic composition of the binary alloy than the composition of the second metal layer. By way of illustration, a bismuth-cadmium alloy has a eutectic composition which contains 40 weight percent cadmium based on weight of alloy. Accordingly, a suitable second metal layer might contain 38 weight percent cadmium whereas a suitable first metal layer might contain only 25 weight percent cadmium, both percentages being based upon weight of alloy.

Kurfman et al., in U.S. Pat. No. 4,115,619 cited hereinabove, teach that the liquidus temperature of an alloy may be raised by adding a minor amount of a high melting metal element to the alloy. Suitable high melting elements include copper, silver, nickel and manganese. As used herein, "minor amount" means from about 5 to about 20 percent by weight of alloy.

A second limitation upon selection of alloy compositions for the first and second metal layers is that a solid metallic phase must be maintained in intimate contact with at least a portion of the polymer layer during forming opeations. In order to ensure compliance with this limitation, the first metal layer must contain at least a minimum amount of the solid metallic phase. The minimum amount is an amount which is greater than that amount which is soluble in the solid or partially liquified metal alloy at the forming temperature of the polymer layer. Suitable results are also obtained when the first metal layer is completely solid.

The solid metallic phase may consist of one or more of the high melting elements noted hereinabove. Alternatively, the solid metallic phase may consist of an intermetallic compound. The solid metallic phase may also consist of an intermetallic compound and at least one of the metals from which the second metal layer is formed.

Suitable intermetallic compounds have incorporated therein at least one of said high melting elements and at least one of the metals from which the second metal layer is formed.

The multilayer composites of the present invention may be prepared by conventional methods and techniques, for making multilayer metal/organic polymer composites wherein the layers of the composites adhere to each other. These methods may be used either singly or in combination.

The first and second metal layers of the duplex alloy structure are suitably applied sequentially. That is, after the first metal layer is adhered to the thermoplastic polymer layer, the second metal layer is adhered to the first metal layer.

One method of depositing the first metal layer on the thermoplastic polymer layer by is the electroless process described by F. A. Lowenheim in "Metal Coatings of Plastics", Noyes Date Corporation, (1970), by Pinter, S. H. et al., *Plastics: Surface and Finish,* Daniel Davey & Company, Inc., 172–186 (1971) or in U.S. Pat. No. 2,464,143.

A second method of depositing the first metal layer on the thermoplastic polymer layer is a vacuum deposition technique wherein the metal is vacuum evaporated and then deposited as a metal layer onto a polymer or a metal layer. See, William Goldie, *Metallic Coating of Plastics,* Volume I, Electrochemical Publications Limited, Chapter 12, (1968).

Other metallization techniques include sputter coating, as described in Chapter 13 of Goldie, supra, and electroplating and ion plating.

The second metal layer may be applied to the first metal layer either by the same process used to apply the first metal layer to the polymer layer or by a different process. For example, the vacuum deposition technique may be used to deposit both the first and the second metal layers.

Deposition of both the first and the second metal layers may be accomplished in a single pass through a vacuum metallization chamber by using sequential exposure. "Sequential exposure," as used herein, means that vacuum deposition of the metal or alloy of the second metal layer onto the first metal layer is started after at least a major portion of the metal or alloy of the first metal layer has been vacuum deposited onto the polymer layer.

Sequential exposure may be accomplished by a number of arrangements. For example, two vacuum evaporation boats may be arranged in a spatial relationship such that a web of thermoplastic polymer passes over a first boat and then over a second boat. The metal or alloy of the first metal layer is fed to the first boat and the metal or alloy of the second layer is fed to the second boat.

The thickness of the first metal layer, although not particularly critical, must be such that it desirably meets three criteria.

First, the first metal layer must be sufficiently thick to form a continuous film over the desired surface of the polymer layer. A continuous film is needed to meet end use requirements such as a highly reflective surface, a high barrier to vapor transmission or electroconductivity.

Second, the first metal layer must have a thickness sufficient to allow the composite to undergo a cumulative surface dimensional change in area of at least 30 percent, beneficially from about 50 to about 300 percent, without rupturing either the metal layer or the polymer layer thereof.

Third, the first metal layer must be sufficiently thick to provide a suitable base upon which to deposit a thicker second layer.

The first metal layer suitably has a thickness less than that which inherently delaminates from the polymer layer. More specifically, the thickness of the first metal layer is beneficially from about 0.005 to about one micrometer. The thickness is desirably from about 0.01 to about 0.5 micrometer, and preferably from about 0.03 to about 0.3 micrometer. The thickness of the first metal layer is most preferably less than 0.1 micrometer if the metal or metal alloy of said first metal layer has a Young's Modulus in excess of ten million pounds per square inch.

The second layer must be sufficiently thick to ensure that the multilayer composite has an optical density measurement, before elongation, of greater than about 2.0, beneficially greater than about 3.0 and desirably greater than about 4.0.

After elongation of about 100 percent, the multilayer composite beneficially retains its pre-elongation optical density measurement. After elongation of about 300 percent, the multilayer composite suitably has an optical density measurement of no less than about 2.0.

Stated differently, the second layer must have a thickness sufficient to ensure that the multilayer composite has a visually and electrically continuous metal layer after deformation or extension within the hereinabove stated limits.

When a duplex metal alloy coating having a thickness of more than about 0.002 inches is desired, it has been found that two additional conditions should be met.

As a first condition the second metal layer should be applied, either as a liquid or as a liquid-solid solution which is predominantly liquid, to a first metal layer which is partially, but not wholly, liquid. Care in selecting metal compositions for the first and second metal layers is necessary to ensure that this condition is met.

As a second condition, the first metal layer must have a thickness which is relatively thin compared to that of the second metal layer. "Relatively thin," as used herein, means that the first metal layer has a thickness which is less than that of the second metal layer but greater than 500 Angstroms.

By complying with the foregoing conditions, a number of benefits are realized.

A first benefit is that the metal or alloy of the second metal layer almost spontaneously "wets out" onto the first metal layer. That is, little or no pressure need be applied to the metal of the second metal layer to cause it to spread in a generally uniform manner over the first metal layer.

A second benefit is that the metal or alloy of the second metal layer will generally conform to the pattern of deposition of the first metal layer. This has been found to be true irrespective of whether said pattern of deposition is continuous or discontinuous.

A third benefit is that mutual alloying which occurs because of interaction between liquid portions of the first and second metal layers enhances bonding between the first and second metal layers.

An alternative procedure for preparing a duplex metal alloy involves depositing the first metal layer on a first polymer layer and the second metal layer on a second polymer layer. The first metal layer and the second metal layer are then fusion bonded by application of heat and pressure. Careful selection of metal layer composition and polymer layers is necessary to provide a strong bond between the metal layers without degrading or destroying either polymer layer.

In preparing a multilayer composite wherein the polymer layer comprises a relatively polar polymer, it is generally not necessary to pretreat the polymer layer prior to application of the first metal layer. Illustrative "polar" polymers are polycarbonate, polyester, polyvinyl halide or polyvinylidene halide, polyvinyl alcohol, acrylic polymers and the like. When the polymer layer comprises a relatively non-polar polymer pretreatment of a surface of the polymer layer to enhance bonding between the first metal layer and the polymer layer is desirable. Polystyrene and polyethylene are examples of "relatively non-polar" polymers.

A suitable pretreatment includes gas phase sulfonation as described in U.S. Pat. No. 3,625,751 to Walles. Gas phase sulfonation is also described by Lindblom et al. in U.S. Pat. No. 3,686,018. Other suitable pretreatments include corona discharge, flame treatment, liquid phase sulfonation and the like.

As an alternative to pretreatment the polymer layer may be coated with an adhesive. Adhesives commonly employed in bonding metal layers to relatively non-polar organic polymer layers may be used. Suitable adhesives include an ethylene/acrylic acid copolymer, an ethylene/vinyl acetate copolymer, and the like.

While the metal layers may be applied to either or both sides of the polymer layer(s), it is generally sufficient to apply the metal layer to only one surface of the polymer layer. It is understood, however, that when a metal layer will be exposed in a final article, such exposed metal layer can be protected by coating it with an adherent material which will not corrode said metal layer.

Materials suitably employed as protective coatings for the metal layer include polycarbonates such as those derived from bisphenol-A and/or phenolphthalein; polyesters, such as polyethylene terephthalate; acrylic polymers, such as poly(methyl methacrylate); vinylidene chloride copolymers; polyepoxides; alkyd resins; polyurethanes and the like.

If a protective coating is to be applied over the metal layer prior to a forming operation, it is necessary to select a coating material which will not rupture during forming.

An exemplary method for overcoating the metal layer is described in U.S. Pat. No. 3,916,048, the teachings of which are incorporated herein by reference thereto. A protective polymer in the form of a latex is applied to the metal layer and dried to form a continuous film at a temperature below the heat distortion point of the polymer layer. By following this technique it is possible to form the metal composite before or after application of the protective coating.

In cases wherein high barrier is desired, it will often be desirable to overcoat the metal layer with a barrier polymer. Suitable barier polymers include vinylidene chloride copolymers and polyvinyl alcohol polymers. A barrier polymer overcoating is not necessary if the barrier polymer is to be used as the polymer layer of the multilayer composite.

A. Wray Britton in *Package Engineering*, Vol. 24, February 1979 (42–43), proposes the use of optical density measurements as a standard measure for film metallization. "Optical density, also known as transmission density, is a measure of transparency of a material. Optical density is a logarithmic scale which quantifies the amount of light transmitted through a material. Optical density is equal to $Log_{10}$ 1/T or Log O or Log 100/Tr, where T=transparency, O=opacity, and Tr=percentage of light."

Britton details a method for determining optical density. "A transmission densitometer passes a beam of light through a test object. A photosensitive device measures the amount of light which passes through the test object. The measure of light transmitted vs. the light available for transmission provides an index. An electrical circuit converts the index to provide a digital readout of optical density."

Britton notes that as a "metallized film moves from transparent (optical density of less than 1.0) to virtually opaque (optical density of 4.0), the barrier properties [of the metallized film] improve." In other words, transmission of oxygen and water vapor through a metallized film decreases as optical density of the film increases.

The multilayer composite of the present invention may be formed to a desired shape by a conventional forming process, e.g., thermoforming or solid phase forming. Thermoforming is suitably carried out at temperatures of from about the second order transition temperature (Tg) of the polymer up to and including temperatures at or above the melting point of the polymer provided the polymer has sufficient melt strength to undergo the forming operation without rupturing.

Exemplary thermoforming processes include differential air pressure thermoforming, match dye thermoforming, vacuum forming, plug assist-vacuum forming, draw forming, impact forming, rubber pad forming, hydroforming, drape molding and the like.

Since most thermoplastic polymers preferably employed in the practice of this invention have melting points of less than 200° Centigrade (473° Kelvin), it is generally advantageous to thermoform the composite at a temperature from about 25° Centigrade (298° Kelvin) to about 200° Centigrade (473° Kelvin), desirably from about 90° Centigrade (363° Kelvin) to about 180° Centigrade (453° Kelvin).

The multilayer composite of the present invention may be used, after forming, without further fabrication. Further fabrication is unnecessary for most packaging and electroconductive applications.

In packaging applications the formed multilayer composite can be used as tubs or similar deep drawn containers for various oxygen sensitive foods as described herein, or as packaging films.

In electroconductive applications, the formed multilayer composite can be used as printed circuit stock for electrical and electronic equipment, and the like.

In addition to the foregoing uses, a formed multilayer composite generally defining a cavity is suitably reinforced by filling the cavity with a reinforcing material. Alternatively, a reinforcing material may be adhered to the surface of the composite outermost from the cavity or concave shape as in the case of the reflector for an automobile headlamp.

The type of reinforcing material employed is not particularly critical. For example, the reinforcing material may be metal such as steel, wood, stone, concrete and polymeric. Polymeric reinforcing materials, either natural or synthetic in origin, are suitable for use in conjunction with the formed multilayer composites of the present invention. Polymeric reinforcing materials may be foamed or nonfoamed, rigid or flexible, elastomeric or non-elastomeric. Polymeric reinforcing materials may also be pure (non-filled) or filled with pigments, stabilizers, reinforcing fibers such as glass fibers, fillers and the like. In addition, the polymeric reinforcing materials may contain crosslinking components.

Suitable rigid polymeric materials include polyurethane, polystyrene, epoxy polymers, polyvinyl chloride, vinylac resin, silicone polymers, cellulosic polymers, acrylic polymers, saturated polyesters and unsaturated polyesters, asphalt and the like. Of these materials the polyurethanes are generally preferred. Rigid polymers and rigid polymer foams are useful in the fabrication of articles which are not exposed to significant amount of impact.

In the production of articles such as bumpers and external trim or automobiles and other vehicles of transportation that are exposed to impact, it is desirable to employ an elastomeric polymer foam as the reinforcing material. Examples of such elastomeric polymers include elastomeric polyurethanes; rubbery styrene/-butadiene copolymers; polybutadiene rubber; natural rubber; ethylene polymers, particularly ethylene/propylene copolymer rubber; chlorinated polyethylene and the like. Blends of two or more of the aforementioned reinforcing materials may also be used. Such elastomeric polymers, whether solid or foamed, and methods for their preparation are well-known to those skilled in the art and therefore will not be discussed in greater detail here.

The reinforcing material is readily cast onto the shaped multilayered composite by any of a wide variety of casting techniques. For example, a reinforcing material may be applied by foamed-in-place or pour-in-place techniques as well as spray applications, slush castings or rotational casting application. Exemplary methods are described in more detail in U.S. Pat. No. 3,414,456. It is desirable that conditions of the casting technique employed be such that the formed composite does not deform during casting, foaming and/or curing steps which may be employed. However, if such deforming conditions are employed at this time, a support mold for the thermoformed composite is required.

The following examples are given to illustrate some specific embodiments of the invention and should not be construed as limiting the scope thereof. In the following examples, all parts and percentages are by weight unless otherwise indicated.

EXAMPLE 1

Two Stage Metallization of a Polycarbonate Substrate

A rectangular section (11 inches by 20 inches) of polycarbonate film having a thickness of 0.005 inch was used as a metallization substrate. The polycarbonate film was derived from bisphenol A and phosgene.

A vacuumizable bell jar having disposed therein a resistance-heated vacuum evaporation boat (crucible) and a wire feeding mechanism was used as a metallization apparatus.

The evaporation boat was machined from graphite and had an evaporation cavity measuring 2 inches in length by ½ inch in width by 5/16 inch in depth. The evaporation boat was electrically attached to a power supply capable of delivering 600 amperes at 5 volts to establish a resistance-heating element.

The polycarbonate film was configured to the shape of a partial cylinder having a radius of about 10 inches by taping the film to a rigid metal sheet of that configuration. The configured film was positioned in the bell jar above the evaporation boat such that the axis of the partial cylinder was aligned with the boat in order to achieve a generally uniform thickness of metal to be deposited on the film.

The wire feeding mechanism was positioned such that a controlled amount of metal wire could be dispensed therefrom into the evaporation cavity of the evaporation boat.

Two one-hundredths of a gram of metallic copper were placed in the evaporation cavity for a first stage metallization. The bell jar was then closed and evacuated to a pressure of about $1\times10^{-4}$ torr.

Electrical current to the filament was turned on and adjusted to a nominal current of 450 amps. The electrical current was sufficient to raise the temperature of the evaporation boat to about 1000° Centigrade and to evaporate the metallic copper contained therein in about 30 seconds.

After the copper was evaporated, the wire feeding mechanism was actuated to introduce 0.5 grams of a binary eutectic wire into the evaporation cavity for a second stage metallization. The rate of feeding of wire and the electrical current were adjusted so that the rate of melting of the metal was approximately equal to the rate of evaporation thereof.

The binary eutectic wire was an alloy of 57 percent by weight of bismuth and 43 percent by weight of tin, both percentages being based on weight of alloy.

After all the eutectic wire had evaporated, the current was turned off. The bell jar was subsequently opened to atmospheric pressure.

Final metal thickness was about 3000 Angstroms as determined by measuring the surface electrical resistance of the metal deposit and calculating thickness based on the bulk electrical resistance of the tin-bismuth alloy. The tin-bismuth alloy wire bulk resistance measurement was 0.06 ohms/foot (1/16 inch diameter wire).

EXAMPLE 2

Use of a Copper-Tin Alloy in the First Stage of a Two Stage Metallization as in Example 1

Using the apparatus and procedures of Example 1 a piece of polycarbonate film having the same size and composition as that of Example 1 was metallized in the first stage with 0.20 grams of a metal alloy. The metal alloy was composed of 0.03 grams of copper and 0.17 grams of tin. As in Example 1, the second stage metallization was conducted with 0.5 grams of the binary (bismuth/tin) eutectic wire. Final metal thickness, determined as in Example 1, was about 4000 Angstroms.

EXAMPLE 3

Two Stage Metallization With a Thicker Polycarbonate Film, and an Increased Amount of Binary Eutectic Wire Using the apparatus and procedures of Example 1, a piece of polycarbonate film similar in every respect to that of Example 1 except that the thickness was 0.015 inch rather than 0.005 inch was metallized. In the first stage metallization, 0.02 grams of copper were placed in the evaporation cavity. Using the procedures detailed by K. L. Chopra, in *Thin Film Phenomena*, McGraw-Hill Book Company, 1969, at pages 91–92, a quartz-crystal monitor (also known as a crystal thickness monitor), was used to monitor rates of deposition of metal onto a metallization substrate. Rates of deposition were then converted to metal layer thickness.

Thickness of the metal layer after the first stage metallization was about 100 Angstroms. In the second stage metallization, conducted in the same manner as Example 1, 1.5 grams of the binary (bismuth/tin) eutectic were added to the evaporation cavity. Final metal thickness was about 9000 Angstroms.

COMPARATIVE EXAMPLE A

Single Stage Metallization

For purposes of comparison, a similar piece of polycarbonate film was metallized in the manner hereinbefore described except that the first stage was omitted. In other words, the evaporation cavity was empty until 1.5 grams of the binary eutectic wire was added thereto as in Examples 1 and 2. Final metal thickness, determined as in Example 1, was about 8900 Angstroms.

COMPARATIVE EXAMPLE B

Single Stage Metallization Using a Ternary Metal Alloy

For purposes of comparison, a piece of polycarbonate film similar to that of Example 1 was metallized in the manner hereinbefore described except that the second stage was omitted. One-half gram of a ternary alloy was substituted for the metallic copper used in the first stage of Example 1. The ternary alloy was composed of 54 weight percent bismuth, 41 weight percent tin and 5 weight percent copper, all percentages being based upon weight of alloy. Electrical current was adjusted to result in evaporation of the alloy in about 30 seconds. Final metal thickness, determined as in Example 1, was about 3000 Angstroms.

COMPARATIVE EXAMPLE C

Metallization of Polycarbonate Film Using Two Evaporation Boats Operated in Sequence For purposes of comparison, the apparatus of Example 1 was modified by replacing the wire feeding mechanism with a second evaporation boat. The second evaporation boat was indentical to the evaporation boat described in Example 1 (first evaporation boat).

Twenty-three one-hundredths of a gram of bismuth were placed into the evaporation cavity of the first boat. Forth-seven one-hundredths of a gram of a tin-copper alloy were placed into the evaporation cavity of the second boat. The alloy was composed of 88 weight percent tin and 12 weight percent copper, both percentages being based on weight of alloy.

The apparatus was closed and evacuated as in Example 1. Electrical current to the first boat was turned on and adjusted to effect evaporation of the bismuth in about 1½ minutes. The crystal thickness monitor showed that a coating of bismuth having a thickness of about 800 Angstroms was deposited on the polycarbonate film (80 micrograms/square centimeter).

After turning off the electrical current to the first boat, the current to the second boat was turned on and adjusted to effect evaporation of the alloy in about 4 minutes. After the alloy had evaporated, the current to the second boat was turned off. The crystal thickness monitor showed that a coating of about 2200 Angstroms of the alloy was deposited over the coating of bismuth (162.9 micrograms per square centimeter).

Final composition of the metal deposited on the polycarbonate film was about 32 weight percent bismuth, 60 weight percent tin and 8 weight percent copper. Final composition was calculated based upon weight of bismuth accumulated by the quartz crystal monitor and upon weight of tin-copper alloy subsequently accumulated by the monitor.

SAMPLE EXTENSION

Metallized film samples were prepared for extension by cutting ½ inch ribbons (1 inch for draws over 200 percent) at least 6 inches long from the film stock prepared described in Examples 1–3 and Comparative Examples A–C.

The center inch of length of the tested ribbon was held securely with the polymer face against a one inch wide copper block. The copper block was controlled at a given test temperature by a thermostat-equipped electrical resistance heating element.

For 5-mil polycarbonate samples, a 3 second sample contact time was allowed for temperature equilibration. Load was then applied to the ribbon ends to extend the sample to final length at a rate of lengthening of about 3 inches/second.

Ribbon thickness was determined before and after extension, by micrometer measurement. The increase in area was determined, assuming constant sample volume, from the relationship Volume=thickness×area. The increase in area divided by the initial area and expressed as a percentage was taken as the percentage area extension.

$$\text{Percent extension} = 100\left[\frac{\text{final area} - \text{initial area}}{\text{initial area}}\right] = 100\left[\frac{\text{initial thickness}}{\text{final thickness}} - 1\right]$$

Optical density measurements, in accordance with Britton's method hereinabove described, were made on each of the metallized films prepared in the preceding examples and comparative examples both before and after the metallized films were extended at 340° Fahrenheit.

Optical density values before and after extension and percentages of extension are summarized in a table which follows.

Table of Optical Density Measurements

| Example/ Comparative Example Number | Optical Density Measurements Before Extension | After Extension | Percent Extension |
|---|---|---|---|
| 1 | >4 | >4 | 100 |
| 2 | >4 | 2 | 100 |
| 3 | >4 | >4 | 100 |
| | | 2 | 300 |
| A | >4 | <1 | 100 |
| B | >4 | <1 | 100 |
| C | >4 | <1 | 100 |

A review of the data set forth in the table is instructive. The temperature chosen for extension (340° Fahrenheit) was 58° Fahrenheit greater than the melting point of the binary eutectic wire (282° Fahrenheit). The polycarbonate had a second order transition temperature at 300° Fahrenheit. In spite of this, the metal layers of Examples 1–3 retained their integrity and their high optical density measurements.

As hereinabove noted, an optical density measurement of about 4.0 indicates that a metallized film has a barrier to oxygen and water vapor which is much greater than that of a metallized film having an optical density measurement of about 1.0.

The comparative examples (especially Comparative Example C) clearly demonstrate that an initial metal layer of bismuth, which has a much higher vapor pressure at a given temperature than either tin or copper, produces less than satisfactory results.

Similar results are obtained with other metals hereinbefore listed as well as with other suitable thermoplastic organic polymer substrates also as hereinbefore listed. As hereinabove noted, a pretreatment of the polymer may be required when using substrates other than polycarbonate, to provide adequate adhesion at the metal layer-polymer layer interface.

What is claimed is:

1. A duplex metal/organic polymer multilayer composite structure, the structure comprising:

(a) at least one normally solid, formable thermoplastic polymer layer, said polymer layer having a forming temperature in degrees Kelvin, a first planar surface and a second planar surface, the first and second planar surfaces being generally parallel to each other;

(b) a first normally solid metal layer, the first metal layer being intimately adhered to at least one planar surface of the polymer layer, said first metal layer being formed from an alloy of two or more metals, said first metal layer having a thickness within the range of from 0.01 micrometers to 0.5 micrometers, the alloy melting at a temperature, or over a range of temperatures, that is within a temperature range of from about 85 to about 150 percent of the forming temperature of the thermoplastic polymer layer, said temperatures being in degrees Kelvin, and (c) a second normally solid metal layer, the second metal layer being intimately adhered to the first metal layer, said second metal layer being formed from a metal or an alloy of two or more metals that melts at a temperature, or over a range of temperatures, which is lower than that at which, or over which, melting of the metal alloy of the first metal layer occurs, said temperatures being in degrees Kelvin.

2. The composite of claim 1 wherein the alloy of the first metal layer has a solidus temperature which is within a range of from about 85 to about 98 percent of the forming temperature of the thermoplastic polymer layer and a liquidus temperature which is within a range of from about 102 to about 150 percent of the forming temperature of the thermoplastic polymer layer, said temperatures being in degrees Kelvin.

3. The composite of claim 1 wherein the alloy of the first metal layer is an alloy containing two or more metals selected from the group consisting of cadmium, indium, tin, antimony, lead, bismuth, or zinc.

4. The composite of claim 3 wherein the alloy also contains copper in an amount of from about 5 to about 40 percent by weight of alloy.

5. The composite of claim 3 wherein the alloy also contains silver in an amount of from about 5 to about 75 percent by weight of alloy.

6. The composite of claim 1 wherein the second metal layer is formed from an alloy of two or more metals selected from the group consisting of cadmium, indium, tin, antimony, lead, bismuth and zinc.

7. The composite of claim 6 wherein the second metal layer has a solidus temperature, a liquidus temperature and a eutectic temperature.

8. The composite of claim 1 wherein the second metal layer is formed from an eutectic binary alloy selected from the group consisting of tin-lead, lead-bismuth, lead-tin, bismuth-tin, bismuth-cadmium, bismuth-indium, cadmium-indium, cadmium-zinc, and cadmium-tin alloys.

9. The composite of claim 1 wherein the thermoplastic polymer layer is selected from the group consisting of polycarbonates, polyesters, acrylic resins, monovinylidene aromatic polymers, vinyl halide polymers, vinylidene halide polymers, or polyacetals.

10. The composite structure of claim 1 wherein the first and second metal layers are in such a proportional relationship with respect to each other that, when taken together and heated to a specific temperature, they comprise a segregated metal alloy of two or more metals, the specific temperature being (1) between the solidus temperature and the liquidus temperature of the first metal layer and (2) greater than the liquidus temperature of the second metal layer, the segregated metal alloy having a melting temperature or melting temperature range, that is within a temperature range of from about 80 to about 135 percent of the forming temperature of the thermoplastic polymer, said temperatures being in degrees Kelvin.

11. The composite of claim 10 wherein the metal of the first metal layer has a solidus temperature which is within a temperature range of from about 85 to about 98 percent of the forming temperature of the thermoplastic polymer and a liquidus temperature which is within a temperature range of from about 102 to about 150 percent of the forming temperature of the thermoplastic polymer, said temperatures being in degrees Kelvin, and the second metal layer has a liquidus temperature which is less than the liquidus temperature of the first metal layer.

12. The composite of claim 10 wherein the first metal layer is of such a composition and proportion relative to the second metal layer that intermetallic phases formed by interaction between the metal layers do not increase the liquidus temperature of the second metal layer beyond 135 percent of the forming temperature of the thermoplastic polymer layer, said temperatures being in degrees Kelvin.

13. The composite of claim 7 wherein the first metal layer is of such a composition and proportion relative to the second metal layer that intermetallic phases formed by interaction between the metals layers do not increase the liquidus temperature of the second metal layer by more than 30 degrees Kelvin above the eutectic temperature of the second metal layer.

14. The composite of claim 13 wherein the metal of the second metal layer is at least 75 weight percent liquid, based on weight of said second metal layer, at a temperature which is not more than 25 degrees Kelvin above said second metal layer's eutectic temperature.

15. The composite of claim 14 wherein the metal of the second metal layer is an alloy which comprises at least 30 weight percent tin and at least 40 weight percent bismuth, both percentages being based upon weight of alloy.

16. A duplex metal/organic polymer multilayer composite structure, the structure comprising:

(a) at least one normally solid, formable thermoplastic polymer layer, said polymer layer having a forming temperature in degrees Kelvin, a first planar surface and a second planar surface, the first and second planar surfaces being generally parallel to each other;

(b) a first normally solid metal layer, the first metal layer being intimately adhered to at least one planar surface of the polymer layer, the metal layer having a thickness within the range of from 0.01 micrometers to 0.5 micrometers, said metal layer being formed from one normally solid metal selected from the group consisting of copper, silver, nickel and manganese; and (c) a second normally solid metal layer, the second metal layer being intimately adhered to the first metal layer, the second metal layer being formed from a metal or an alloy of two or more metals, said second metal layer being in such a proportional relationship with respect to the first metal layer that the two metal layers, when taken together and heated to the forming temperature of the polymer layer, comprise a segregated alloy of at least two metals, the segregated alloy having a melting temperature or melting temperature range that is within a temperature range of from about 80 to about 135 percent of the forming temperature of the polymer layer, said temperatures being in degrees Kelvin.

* * * * *